US010984729B2

(12) United States Patent
Kimura et al.

(10) Patent No.: US 10,984,729 B2
(45) Date of Patent: Apr. 20, 2021

(54) GRAY-SCALE VOLTAGE GENERATING CIRCUIT TO CONTROL LUMINANCE OF THE DISPLAY UNIT

(71) Applicant: SONY CORPORATION, Tokyo (JP)

(72) Inventors: Kei Kimura, Kanagawa (JP); Yusuke Onoyama, Kanagawa (JP); Junichi Yamashita, Tokyo (JP)

(73) Assignee: SONY CORPORATION, Tokyo (JP)

( * ) Notice: Subject to any disclaimer, the term of this patent is extended or adjusted under 35 U.S.C. 154(b) by 149 days.

(21) Appl. No.: 15/905,950

(22) Filed: Feb. 27, 2018

(65) Prior Publication Data

US 2018/0190208 A1 Jul. 5, 2018

Related U.S. Application Data

(63) Continuation of application No. 14/190,840, filed on Feb. 26, 2014, now Pat. No. 9,940,877.

(30) Foreign Application Priority Data

Mar. 21, 2013 (JP) ..... JP2013-058301

(51) Int. Cl.
*G09G 3/3291* (2016.01)
*G09G 3/3225* (2016.01)

(52) U.S. Cl.
CPC ..... *G09G 3/3291* (2013.01); *G09G 3/3225* (2013.01); *G09G 2300/0852* (2013.01); *G09G 2310/027* (2013.01); *G09G 2320/0285* (2013.01)

(58) Field of Classification Search
CPC ..... G09G 3/3233; G09G 2320/0285; G09G 2340/16; G09G 2330/028; G09G 3/3696
See application file for complete search history.

(56) References Cited

U.S. PATENT DOCUMENTS 5,381,082 A 1/1995 Schlicht
6,380,794 B1 4/2002 Foroudi et al.
(Continued)

FOREIGN PATENT DOCUMENTS

JP 2007-233109 A 9/2007

OTHER PUBLICATIONS

"Low-Power, 13-Bit Voltage-Output DACs with Serial Interface." MAX535, MAX5351. Maxim Integrated Products, Dec. 1996. Web. <https://www.maximintegrated.com/en/datasheet/index.mvp/id/1480>.

(Continued)

*Primary Examiner* — Yuzhen Shen
(74) *Attorney, Agent, or Firm* — Chip Law Group

(57) ABSTRACT

A gray-scale voltage generating circuit includes: a ladder resistor circuit including a plurality of resistors connected in series to one another, and configured to output a plurality of gray-scale voltages with different voltage values from ends of the respective resistors; and a constant current source configured to be connected in series to the ladder resistor circuit, in which the constant current source includes a current source transistor configured to be connected in series to the ladder resistor circuit, and a voltage setting section configured to select one voltage from the plurality of voltages and set the selected voltage as a voltage determining a current that is to flow through the current source transistor.

12 Claims, 8 Drawing Sheets

(56) References Cited

U.S. PATENT DOCUMENTS

2002/0093315 A1* 7/2002 Sluijs ..... H02M 3/158 323/267
2003/0151577 A1 8/2003 Morita
2004/0095340 A1 5/2004 Nakamura
2004/0104870 A1* 6/2004 Mametsuka ..... G09G 3/3233 345/76
2005/0007393 A1 1/2005 Akai et al.
2005/0057457 A1* 3/2005 Date ..... G09G 3/3283 345/76
2005/0062691 A1 3/2005 Tamura et al.
2005/0104819 A1* 5/2005 Shimoda ..... G09G 3/3283 345/76
2005/0116904 A1* 6/2005 Adachi ..... G09G 3/3216 345/76
2005/0190129 A1* 9/2005 Adachi ..... G09G 3/2011 345/76
2006/0023001 A1* 2/2006 Sung ..... G09G 3/3688 345/690
2006/0192695 A1 8/2006 Nishimura
2007/0024544 A1* 2/2007 Chung ..... G09G 3/3233 345/76
2007/0063948 A1 3/2007 Nishimura
2011/0227903 A1* 9/2011 Choi ..... G09G 3/3291 345/212
2011/0273441 A1* 11/2011 Shin ..... G09G 3/3225 345/419
2013/0200877 A1* 8/2013 Nakatsuka ..... G05F 3/16 323/313

OTHER PUBLICATIONS

Haubner, Georg. "Understand the Differences between R2R and String DAC Architectures." Planet Analog. N.p., Oct. 10, 2007. Web. <http://www.planetanalog.com/document.asp?doc_id=527548>.
Jones, Victor. "DC Voltage and Current Sources." EE 105, Week 11, Spring 2000. Feb. 5, 2009. Web. <http://people.seas.harvard.edu/~jones/es154/lectures/lecture_ 6/pdfs/lecture26.pdf>.
Notice of Allowance for U.S. Appl. No. 14/190,840, dated Nov. 30, 2017, 08 pages.
Non-Final Office Action for U.S. Appl. No. 14/190,840, dated Jun. 20, 2017, 24 pages.
Final Office Action for U.S. Appl. No. 14/190,840, dated Dec. 16, 2016, 26 pages.
Non-Final Office Action for U.S. Appl. No. 14/190,840, dated May 18, 2016, 23 pages.

* cited by examiner $$I_{oled} = \frac{1}{2}\mu C_{ox}\frac{W}{L}(V_{gs}-V_{th})^2 = \frac{1}{2}\mu C_{ox}\frac{W}{L}\left(\frac{R_{sig}}{R_{gam}}V_{cc}-V_{th}\right)^2 \quad \cdots (1)$$

$$I_{oled}' = \frac{1}{2}\mu C_{ox}\frac{W}{L}(V_{gs}'-V_{th})^2 = \frac{1}{2}\mu C_{ox}\frac{W}{L}\left[\frac{R_{sig}}{R_{gam}}(V_{cc}+\Delta V)-V_{th}\right]^2 \quad \cdots (2)$$

| | | RESISTOR | | | |
|---|---|---|---|---|---|
| | | 1 | 2 | 3 | 4 |
| CURRENT | 1 | 0000 | 0001 | 0010 | 0011 |
| | 2 | 0100 | 0101 | 0110 | 0111 |
| | 3 | 1000 | 1001 | 1010 | 1011 |
| | 4 | 1100 | 1101 | 1110 | 1111 |

GRAY-SCALE VOLTAGE GENERATING CIRCUIT TO CONTROL LUMINANCE OF THE DISPLAY UNIT

CROSS REFERENCE TO RELATED APPLICATIONS

The present application is a continuation application of U.S. patent application Ser. No. 14/190,840, filed Feb. 26, 2014, which claims the benefit of priority from Japanese Patent Application 2013-058301 filed in the Japan Patent Office on Mar. 21, 2013, the entire contents of each of the above are hereby incorporated by reference.

BACKGROUND

The present disclosure relates to a gray-scale voltage generating circuit and a display unit.

A display unit using a digital image signal as an input includes a digital-analog conversion circuit that converts an input digital image signal into an analog image signal. Types of digital-analog conversion circuit include a gray-scale voltage selecting type digital-analog conversion circuit in which a digital image signal is converted into an analog image signal by selecting one gray-scale voltage corresponding to the digital image signal from a plurality of gray-scale voltages corresponding in number to bits of the digital image signal. As a gray-scale voltage generating circuit that generates a plurality of gray-scale voltages, there is known a gray-scale voltage generating circuit using a ladder resistor circuit that includes a plurality of resistors connected in series to one another and outputs a plurality of gray-scale voltages with different voltage values from ends (nodes) of the respective resistors (for example, refer to Japanese Unexamined Patent Application Publication No. 2007-233109).

SUMMARY

When a gray-scale voltage is generated by resistive voltage division by the ladder resistor circuit, a voltage value of the gray-scale voltage is changed at a resistive voltage division ratio by a power supply tolerance of a reference voltage (power supply voltage) of the gray-scale voltage generating circuit. For example, in a case where a P-channel transistor is used as a drive transistor that drives a light-emitting device, a change amount of a source potential and a change amount of a gate potential (a voltage value of the gray-scale voltage) in the drive transistor are different from each other; therefore, an overdrive voltage of the drive transistor is changed, and as a result, luminance is changed.

Therefore, it is desirable to provide a gray-scale voltage generating circuit capable of reducing luminance change caused by a power supply tolerance, and a display unit using the gray-scale voltage generating circuit to generate an analog voltage (a gray-scale voltage) in digital-analog conversion.

According to an embodiment of the present disclosure, there is provided a gray-scale voltage generating circuit including: a ladder resistor circuit including a plurality of resistors connected in series to one another, and configured to output a plurality of gray-scale voltages with different voltage values from ends of the respective resistors; and a constant current source configured to be connected in series to the ladder resistor circuit, in which the constant current source includes a current source transistor configured to be connected in series to the ladder resistor circuit, and a voltage setting section configured to select one voltage from the plurality of voltages and set the selected voltage as a voltage determining a current that is to flow through the current source transistor.

According to an embodiment of the present disclosure, there is provided a display unit including: a pixel section configured by arranging pixel circuits each including a light-emitting device; a gray-scale voltage generating circuit including a ladder resistor circuit and a constant current source, the ladder resistor circuit including a plurality of resistors connected in series to one another, and configured to output a plurality of gray-scale voltages with different voltage values from ends of the respective resistors, the constant current source configured to be connected in series to the ladder resistor circuit; and a drive section configured to convert an input digital image signal into an analog image signal by selecting one gray-scale voltage corresponding to the digital image signal from the plurality of gray-scale voltages generated by the gray-scale voltage generating circuit and drive the light-emitting device by the analog signal, in which the constant current source includes a current source transistor configured to be connected in series to the ladder resistor circuit, and a voltage setting section configured to select one voltage from the plurality of voltages and set the selected voltage as a voltage determining a current that is to flow through the current source transistor.

In the gray-scale voltage generating circuit with the above-described configuration or the display unit with the above-described configuration, since gray-scale voltages are generated by an IR drop from a reference voltage (a power supply voltage) of the gray-scale voltage generating circuit caused by a current value I of the constant current source and a resistance value R of the ladder resistor circuit; therefore, a potential difference between the reference voltage and the gray-scale voltage is constant. Thus, even though there is a power supply tolerance, a potential difference between a gate and a source of the drive transistor is not changed; therefore, as long as the drive transistor operates in a saturation region, luminance is not changed. Moreover, when one voltage is selected from the plurality of voltages, and the selected voltage is set as the voltage determining the current that is to flow through current source transistor, the gray-scale voltage generating circuit and the display unit are capable of coping with variations in the resistance value of each of the resistors of the ladder resistor circuit.

In the embodiments of the present disclosure, even though there is the power supply tolerance, the potential difference between the gate and the source of the drive transistor is not changed; therefore, luminance change caused by the power supply tolerance is allowed to be reduced. Moreover, since the gray-scale voltage generating circuit and the display unit according to the embodiments of the present disclosure are capable of coping with variations in the resistance value of each of the resistors of the ladder resistor circuit, variations in voltage values of gray-scale voltages caused by the variations in the resistance value of each of the resistors of the ladder resistor circuit are allowed to be corrected.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the technology, and are incorporated in and constitute a part of this specification. The drawings illustrate embodiments and, together with the specification, serve to explain the principles of the technology.

DETAILED DESCRIPTION

Figure 1:
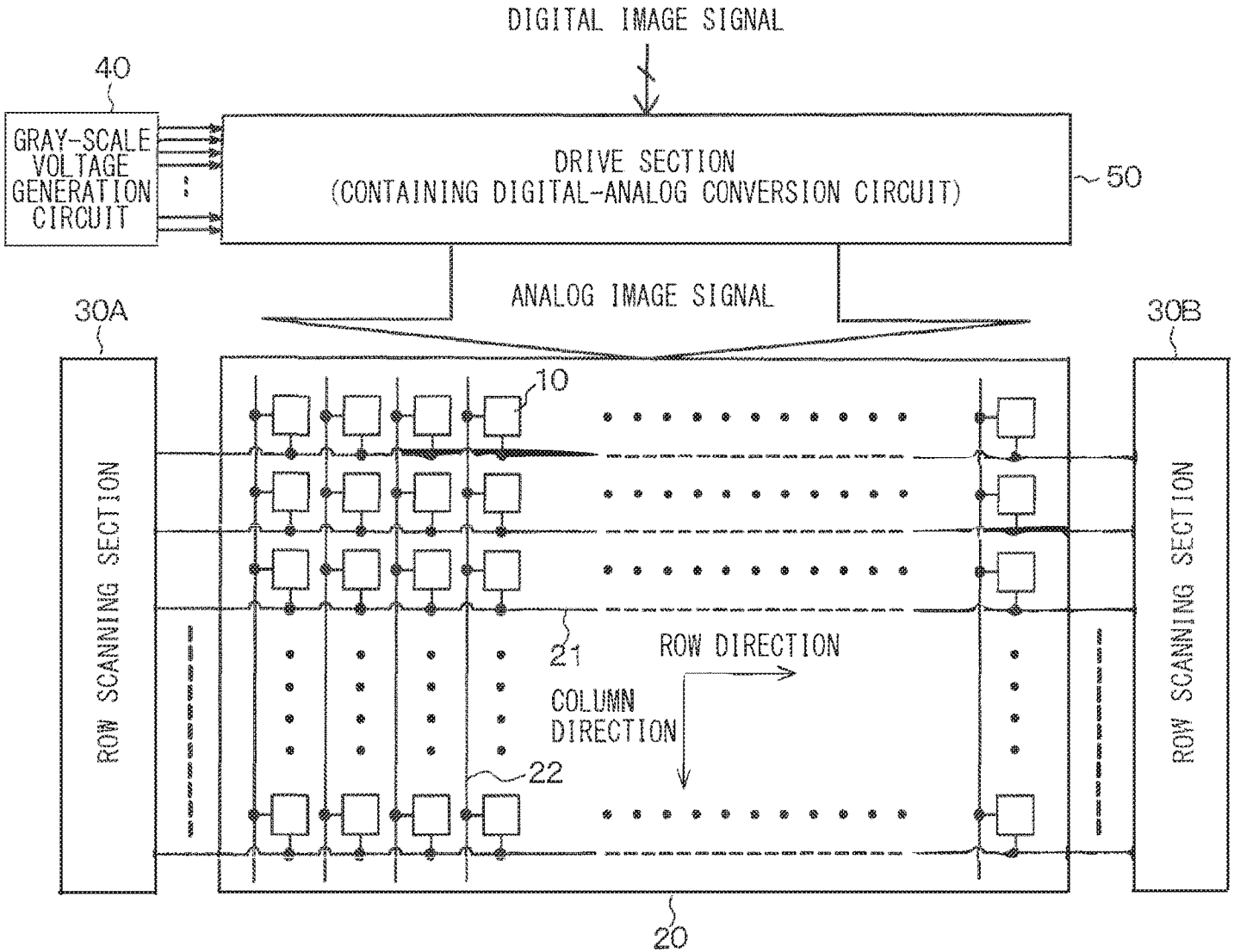
FIG. 1 is a block diagram illustrating a schematic system configuration of an active matrix organic EL display unit according to an application example of an embodiment of the present disclosure.

Some embodiments of the present disclosure will be described detail below referring to the accompanying drawings. The present disclosure is not limited to the embodiments, and various numerical values and materials in the embodiments are merely examples. In the following description, same components or components with same function are denoted by same reference numerals, and description of the components will not be repeated. It is to be noted that description will be given in the following order.

1. General description of gray-scale voltage generating circuit and display unit according to embodiment of present disclosure
2. Display unit to which embodiment of present disclosure is applied 2-1. System configuration
2-2. Drive section containing DA conversion circuit
2-3. Pixel circuit
2-4. About power supply tolerance 3. Description of embodiment 3-1. Example 1
3-2. Example 2

4. Configurations of present disclosure (1. General Description of Gray-Scale Voltage Generating Circuit and Display Unit According to Embodiment of Present Disclosure)

A gray-scale voltage generating circuit according to an embodiment of the present disclosure includes a ladder resistor circuit including a plurality of resistors connected in series to one another, and configured to output a plurality of gray-scale voltages with different voltage values from ends of the respective resistors; and a constant current source configured to be connected in series to the ladder resistor circuit, in which the constant current source includes a current source transistor configured to be connected in series to the ladder resistor circuit, and a voltage setting section configured to select one voltage from a plurality of voltages and set the selected voltage as a voltage determining a current that is to flow through the current source transistor.

Moreover, the gray-scale voltage generating circuit according to the embodiment of the present disclosure is used as a gray-scale generating circuit configured to generate a plurality of gray-scale voltages in a display unit that is configured by arranging pixel circuits each including a light-emitting device. The display unit converts an input digital image signal into an analog image signal by selecting one gray-scale voltage corresponding to the input digital image signal from a plurality of gray-scale voltages, and drives the light-emitting devices by the analog image signal.

An example of the light-emitting device of the pixel circuit may be an organic electroluminescence device (hereinafter, simply referred to as "organic EL device") using a phenomenon in which light is emitted by applying an electric field to an organic thin film. The organic EL device is an example of a current-driven light-emitting device (electro-optic device). Examples of the current-driven light-emitting device may include, in addition to the organic EL device, an inorganic EL device, an LED device, and a laser diode device.

An organic electroluminescence display unit (hereinafter, simply referred to as "organic EL display unit") using the organic EL device as a light emission section (a light-emitting device) of a pixel (a pixel circuit) has the following characteristics. Since the organic EL device is allowed to be driven at an applied voltage of 10 V or less, the organic EL display unit features low power consumption. Since the organic EL device is a self-luminous device, the organic EL display unit has higher visibility of an image, compared to a liquid crystal display unit that is also a flat display unit. Moreover, an illumination member such as a backlight is not necessary in the organic EL display unit; therefore, the weight and thickness of the organic EL display unit are easily reduced. Further, the response speed of the organic EL device is extremely high, i.e., about several μsec; therefore, in the organic EL display unit, an afterimage does not occur during displaying of a moving image.

In the gray-scale generating circuit and the display unit with the above-described preferable configuration and mode according to the embodiment of the present disclosure, the voltage setting section may include a voltage output section and a voltage selection section. The voltage output section includes a plurality of resistors connected in series to one another between a first power supply and a second power supply and is configured to output a plurality of voltages from ends of the respective resistors. The voltage selection section is configured to select one voltage from the plurality of voltages as a voltage determining a current that is to flow through the current source transistor. At this time, the voltage setting section may be configured to select one voltage from the plurality of voltages, based on a resistance value of a resistor of the ladder resistor circuit. Alternatively, the voltage setting section may be configured to select one voltage from the plurality of voltages, based on a current flowing through the current source transistor when a gate voltage of the current source transistor is set as a voltage of the first power supply.

Moreover, in the gray-scale generating circuit and the display unit with the above-described preferable configuration and mode according to the embodiment of the present disclosure, the voltage setting section may be configured to select one voltage from the plurality of voltages and set the selected voltage as a gate voltage of the current source transistor.

Alternatively, the gray-scale generating circuit and the display unit with the above-described preferable configuration and mode according to the embodiment of the present disclosure may include, in addition to the current source transistor, a reference resistor configured to be connected to one of source and drain electrodes of the current source transistor, and a differential amplifier configured to drive the current source transistor, based on a difference voltage between a voltage of a connection node between the current source transistor and the reference transistor and a predetermined reference voltage, and the voltage setting section may be configured to select one voltage from the plurality of voltages and set the selected voltage as the predetermined reference voltage that is to be supplied to the differential amplifier.

Alternatively, in the display unit with the above-described preferable configuration and mode according to the embodiment of the present disclosure, the pixel circuit may include a drive transistor that is configured of a P-type transistor and is configured to supply a current corresponding to a gate potential to the light-emitting device. Moreover, a common power supply may be used for the pixel circuits and the ladder resistor circuit. Further, a resistance value of each of the resistors of the ladder resistor circuit may be determined by gamma characteristics of a pixel section.

(2. Display Unit to which Embodiment of Present Disclosure is Applied)

An active matrix organic EL display unit that uses, as a light emission section (a light-emitting device) of a pixel (a pixel circuit), an organic EL device that is an example of a current-driven light-emitting device will be described as an example of a display unit to which an embodiment of the present disclosure is applied. However, application of the embodiment of the present disclosure is not limited to the organic EL display unit. The embodiment of the present disclosure is applicable to any of display units that convert an input digital image signal into an analog image signal by selecting one gray-scale voltage corresponding to the input digital image signal from a plurality of gray-scale voltages generated by a gray-scale voltage generating circuit, and drive light-emitting devices by the analog image signal.

[2-1. System Configuration]

FIG. 1 is a block diagram illustrating a schematic system configuration of an active matrix organic EL display unit according to an application example of the embodiment of the present disclosure.

As illustrated in FIG. 1, the active matrix organic EL display unit according to this application example may include a pixel section 20 configured by two-dimensionally arranging pixels 10 each including a light-emitting device (a light emission section) in a matrix form, for example, two row scanning sections 30A and 30B, a gray-scale voltage generating circuit 40, and a drive section 50. In the pixel section 20, scanning lines 21 are wired to respective pixel rows of an arrangement of the pixels in the matrix form, and signal lines 22 are wired to respective pixel columns of the arrangement of the pixels.

The row scanning sections 30A and 30B are disposed on both sides, i.e., a left side and a right side of the pixel section 20. Each of the row scanning sections 30A and 30B is configured of a shift register, an address decoder, and the like. The row scanning sections 30A and 30B sequentially output scanning signals for selection of a row of the pixels 10 of the pixel section 20 to the scanning lines 21 from both sides, i.e., the left side and the right side of the pixel section 20. It is to be noted that, in this case, the row scanning sections 30A and 30B are arranged on both sides, i.e., the left side and the right side of the pixel section 20; however, the row scanning section 30A or 30B may be arranged on only one of the left side and the right side. However, in consideration of delay of transmission of the scanning signal in the scanning line, or the like, the row scanning sections 30A and 30B may be preferably arranged on both sides, i.e., the left side and the right side of the pixel section 20.

Although the gray-scale voltage generating circuit 40 will be described in detail later, the gray-scale generating circuit 40 is configured of a ladder resistor circuit. The ladder resistor circuit includes a plurality of resistors connected in series to one another, and is configured to output a plurality of gray-scale voltages with different voltage values from ends of the respective resistors. The ladder resistor circuit generates gray-scale voltages corresponding in number to bits of a digital image signal input to the drive section 50. For example, in a case where the digital image signal has 8 bits, the ladder resistor circuit generates 256 gray-scale voltages.

The drive section 50 contains a digital-analog conversion circuit (hereinafter, may be referred to as "DA conversion circuit"), and is configured to convert an input digital image signal into an analog image signal by selecting one gray-scale voltage corresponding to the input digital image signal from the plurality of gray-scale voltages generated by the gray-scale voltage generating circuit 40. The analog image signal output from the drive section 50 is supplied, through the signal line 22, to a pixel row selected and scanned by the row scanning sections 30A and 30B, and the light-emitting devices of the pixels 10 in the selected and scanned pixel row are driven to emit light.

[2-2. Drive Section Containing DA Conversion Circuit]

Figure 2:
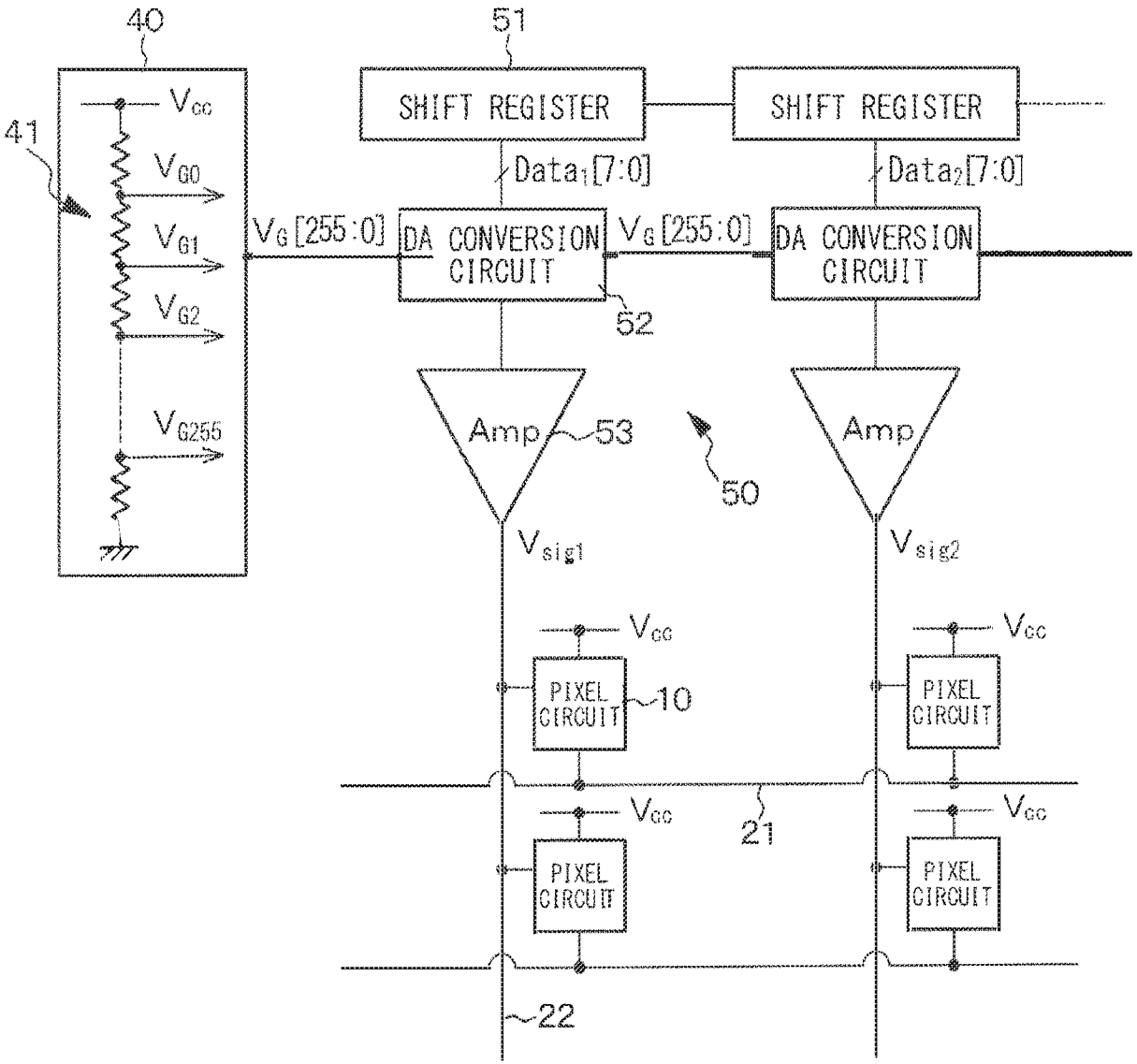
FIG. 2 is a circuit diagram illustrating an example of a configuration of a drive section containing a DA conversion circuit.

FIG. 2 is a circuit diagram illustrating an example of a configuration of the drive section containing the DA conversion circuit. FIG. 2 also illustrates a circuit example of a ladder resistor circuit 41 including a plurality of resistors connected in series to one another in the gray-scale voltage generating circuit 40. In this case, an example in which the digital image signal has 8 bits and the gray-scale generating circuit 30 generates 256 gray-scale voltages $V_{G0}$ to $V_{G255}$ corresponding to the digital image signal is illustrated.

As illustrated in FIG. 2, the drive section 50 has a configuration in which a unit circuit configured of a shift register 51, a DA conversion circuit 52, and an amplifier 53 is provided to each of the pixel columns, i.e., each of the signal lines 22. The shift register 51 outputs 8-bit image data Data [7:0] to the corresponding pixel column. The DA conversion circuit 52 selects one gray-scale voltage corresponding to the image data Data [7:0] output from the shift register 51 from the 256 gray-scale voltages $V_{G0}$ to $V_{G255}$, and outputs the selected gray-scale voltage. The amplifier 53 amplifies the gray-scale voltage output from the DA conversion circuit 52, and outputs the amplified gray-scale voltage as an analog image signal $V_{sig}$ to the signal line 22. Thus, the light-emitting devices of the pixels 10 are driven to emit light.

In the gray-scale voltage generating circuit 40, the ladder resistor circuit 41 has a configuration in which resistors corresponding in number to bits of the digital image signal are connected in series to one another between a first power supply (a power supply on a high potential side) Vcc and a second power supply (a power supply on a low potential side, in this example, a ground GND). A voltage $V_{cc}$ of the first power supply serves as a reference voltage of the gray-scale voltage generating circuit 40 (the ladder resistor circuit 41). In this case, a resistance value of each of the resistors of the ladder resistor circuit 41 may be determined, based on, for example, gamma characteristics of the pixel section 20. Moreover, a power supply on a high potential side of the ladder resistor circuit 41 also serves as the power supplies $V_{cc}$ on the high potential side of the pixels (pixel circuits) 10.

[2-3. Pixel Circuit]

Figure 3:
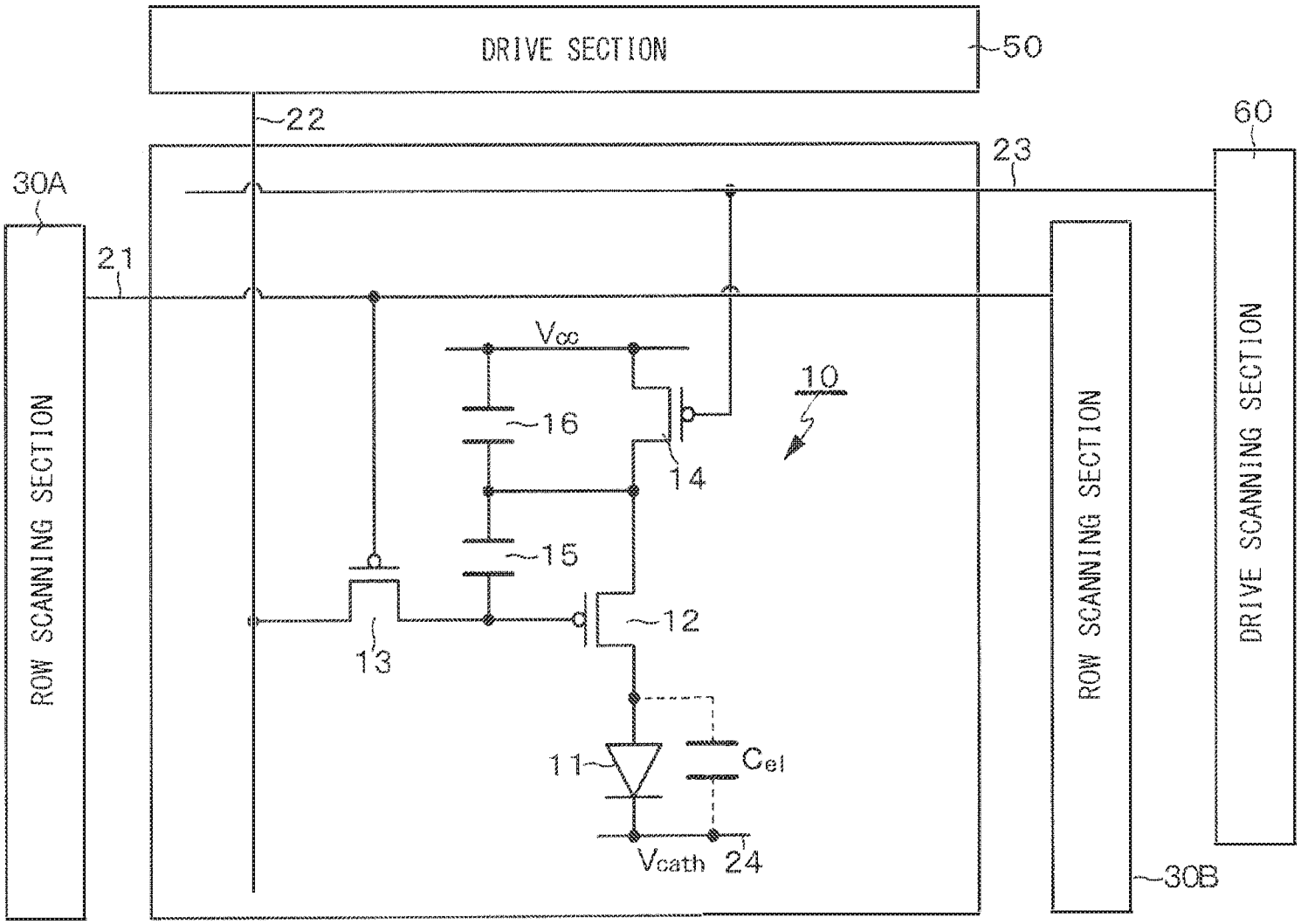
FIG. 3 is a circuit diagram illustrating an example of a configuration of a pixel (a pixel circuit) in the active matrix organic EL display unit.

FIG. 3 is a circuit diagram illustrating an example of a configuration of the pixel (pixel circuit) in the active matrix organic EL display unit.

As illustrated in FIG. 3, the pixel 10 is configured of an organic EL device 11 as an example of the current-driven light-emitting device and a drive circuit configured to drive the organic EL device 11 by allowing a current to flow through the organic EL device 11. A cathode electrode of the organic EL device 11 is connected to a common power supply line 24 wired to all of the pixels 10.

The drive circuit that drives the organic EL device 11 includes a drive transistor 12, a sampling transistor 13, a light emission control transistor 14, a retention capacitor 15, and an auxiliary capacitor 16. It is to be noted that, assuming that the drive circuit is formed not on an insulator such as a glass substrate but on a semiconductor such as silicon, a P-channel transistor is used as the drive transistor 12. Moreover, in this circuit example, as with the drive transistor 12, P-channel transistors are used as the sampling transistor 13 and the light emission control transistor 14.

In this circuit example, in addition to the drive transistor 12 and the sampling transistor 13, the light emission control transistor 14 is included as the pixel transistor. Therefore, in addition to the row scanning sections 30A and 30B illustrated in FIG. 1, the active matrix organic EL display unit includes a drive scanning section 60 configured to drive the light emission control transistor 14. The drive scanning section 60 outputs light emission control signals for driving of the light emission control transistors 14 from one row to another to control lines 23 wired to respective pixel rows.

In the pixel 10 with the above-described configuration, the sampling transistor 13 samples the signal voltage $V_{sig}$ of the image signal supplied from the drive section 50 through the signal line 22 during driving by scanning signals supplied from the row scanning sections 30A and 30B to write the signal voltage $V_{sig}$ to the pixel. The light emission control transistor 14 is connected in series to the drive transistor 12. More specifically, the light emission control transistor 14 is connected between the power supply $V_{cc}$ and a source electrode of the drive transistor 12, and performs control of emission/non-emission of light from the organic EL device 11 during driving by a light emission control signal supplied from the drive scanning section 60.

The retention capacitor 15 is connected between a gate electrode and the source electrode of the drive transistor 12, and holds the signal voltage $V_{sig}$ written by sampling by the sampling transistor 13. The drive transistor 12 allows a drive current corresponding to the signal voltage $V_{sig}$ held by the retention capacitor 15 to flow through the organic EL device 11, thereby driving the organic EL device 11 so as to emit light. The auxiliary capacitor 16 is connected between the source electrode of the drive transistor 12 and a node of a fixed potential, for example, the power supply $V_{cc}$, and exerts a function of reducing variation in a source potential of the drive transistor 12 caused when the signal voltage $V_{sig}$ is written.

In this case, since the organic EL device 11 is a current-driven light-emitting device, the organic EL device 11 obtains gray scales of light emission by controlling a current value flowing therethrough. To control the current value flowing through the organic EL device 11, an overdrive voltage when the signal voltage $V_{sig}$ of the image signal is written to the gate electrode of the drive transistor 12 to use the drive transistor 12 as a current source is controlled. The overdrive voltage is a higher voltage than a voltage allowing a desired gray scale to be obtained.

It is to be noted that, in this circuit example, the pixel circuit including the light emission control transistor 14 in addition to the drive transistor 12 and the sampling transistor 13 is described as an example; however, the pixel circuit may have a circuit configuration not including the light emission control transistor 14. Moreover, the pixel circuit using the P-channel transistor as the pixel transistor is described as an example; however, a pixel circuit using an N-channel transistor is not excluded.

[2-4. About Power Supply Tolerance]

Figure 4A:
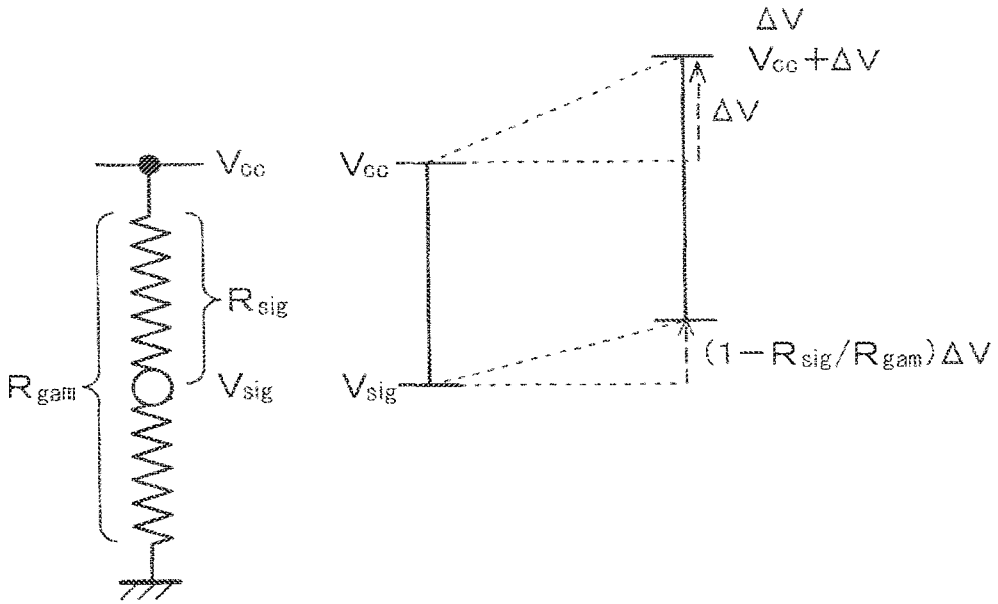
FIG. 4A is a diagram illustrating a state in which a voltage value of a gray-scale voltage is changed at a resistive voltage division ratio by a power supply tolerance.

In the gray-scale voltage generating circuit 40, when a gray-scale voltage is generated by resistive voltage division by the ladder resistor circuit 41, a voltage value of the gray-scale voltage is changed at a resistive voltage division ratio by a power supply tolerance of the power supply $V_{cc}$ of the gray-scale voltage generating circuit 40 (refer to FIG. 4A). In this case, for example, a case where the drive transistor 12 driving the organic EL device 11 is configured of a P-channel transistor, and the common power supply ($V_{cc}$) is used for the gray-scale voltage generating circuit 40 and the pixels 10 is considered. In this case, a change amount of the source potential and a change amount of the gate potential (a voltage value of the gray-scale voltage) in the drive transistor 12 are different from each other; therefore, the overdrive voltage of the drive transistor 12 is changed. As a result, a current Idea supplied from the drive transistor 12 to the organic EL device 11 is changed, thereby causing luminance change (refer to FIG. 4B). This luminance change is caused by the power supply tolerance, thereby causing luminance variations in the market of display panels.

In the ladder resistor circuit 41 schematically illustrated in FIG. 4A, an entire resistance value is $R_{gam}$, and a resistance value allowing the signal voltage (gray-scale voltage) $V_{sig}$ to be generated is $R_{sig}$. While the voltage $V_{cc}$ is changed only by a power supply tolerance ΔV, the voltage value of the gray-scale voltage is changed at the resistive voltage division ratio ($=R_{sig}/R_{gam}$).

Figure 4B:
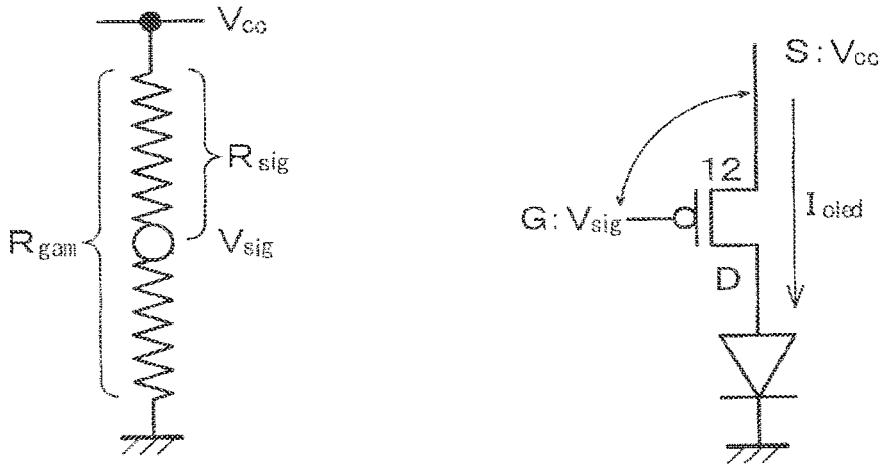
FIG. 4B is a diagram describing change in a current Idea supplied from a drive transistor to an organic EL device by change in the voltage value of the gray-scale voltage.

FIG. 4B illustrates an expression (1) that determines a desired current $I_{oled}$ flowing through the organic EL device 11 and an expression (2) that determines a current $O_{oLed}'$ flowing through the organic EL device 11 after change by the power supply tolerance ΔV. In these expressions (1) and (2), μ is mobility of a semiconductor thin film forming a channel of the drive transistor 12, $V_{th}$ is a threshold voltage, and $V_{gs}$ is a gate-source voltage. Moreover, W is a channel width of the drive transistor 12, L is a channel length, and Cox is a gate capacity per unit area.

(3. Description of Embodiment)

Figure 5A:
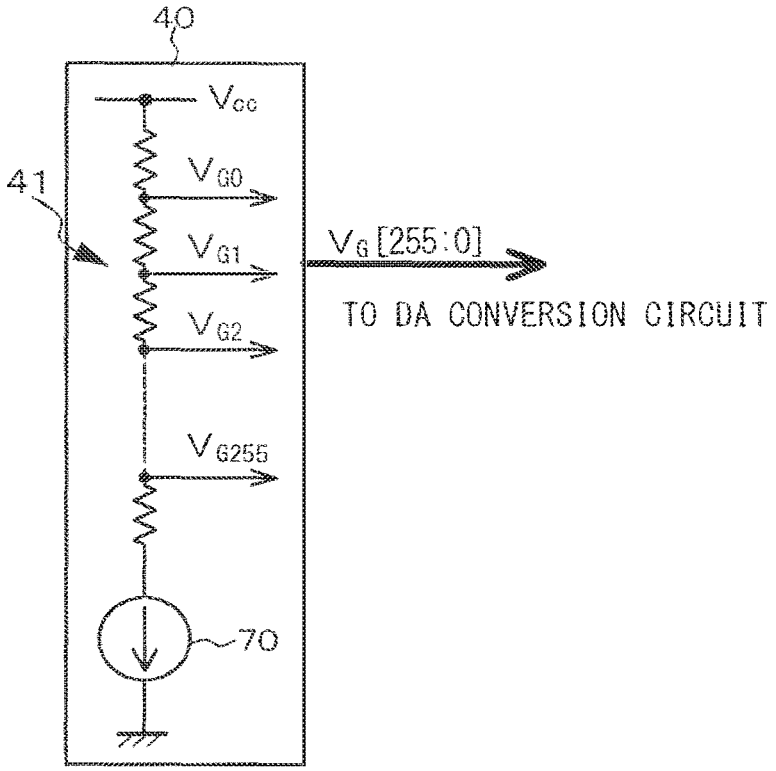
FIG. 5A is a circuit diagram illustrating a configuration of a gray-scale voltage generating circuit according to an embodiment of the present disclosure.

The technology of this embodiment of the present disclosure is made to reduce luminance change caused by the power supply tolerance ΔV. FIG. 5A is a circuit diagram illustrating a configuration of the gray-scale voltage generating circuit according to this embodiment of the present disclosure. As illustrated in FIG. 5A, the gray-scale voltage generating circuit 40 according to this embodiment includes a constant current source 70 connected in series to the ladder resistor circuit 41 outputting a plurality of gray-scale voltages with different voltage values, for example, 256 gray-scale voltages $V_{G0}$ to $V_{G255}$ from ends of the plurality of resistors.

Figure 5B:
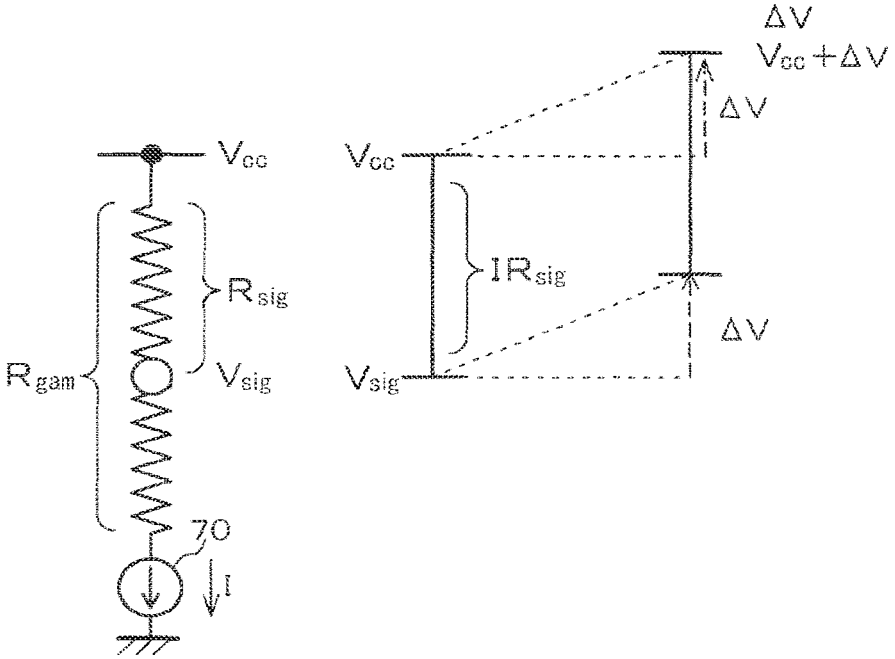
FIG. 5B is a diagram describing functions and effects of the gray-scale voltage generating circuit according to the embodiment.

In the gray-scale voltage generating circuit 40 with the above-described configuration according to this embodiment, as illustrated in FIG. 5B, the gray-scale voltages $V_{G0}$ to $V_{G255}$ are generated by an IR drop from the reference voltage $V_{cc}$ caused by a current value I of the constant current source 70 and a resistance value R ($R_{gam}$) of the ladder resistor circuit 41. Therefore, a potential difference between the reference voltage $V_{cc}$ and the gray-scale voltages $V_{G0}$ to $V_{G255}$ is constant. Thus, even though there is the power supply tolerance ΔV, a potential difference between the gate and the source of the drive transistor 12 is not changed; therefore, as long as the drive transistor 12 operates in a saturation region, luminance is not changed. Accordingly, luminance change caused by the power supply tolerance ΔV is allowed to be reduced.

Specific examples of the constant current source 70 will be described below.

3-1. Example 1

Figure 6:
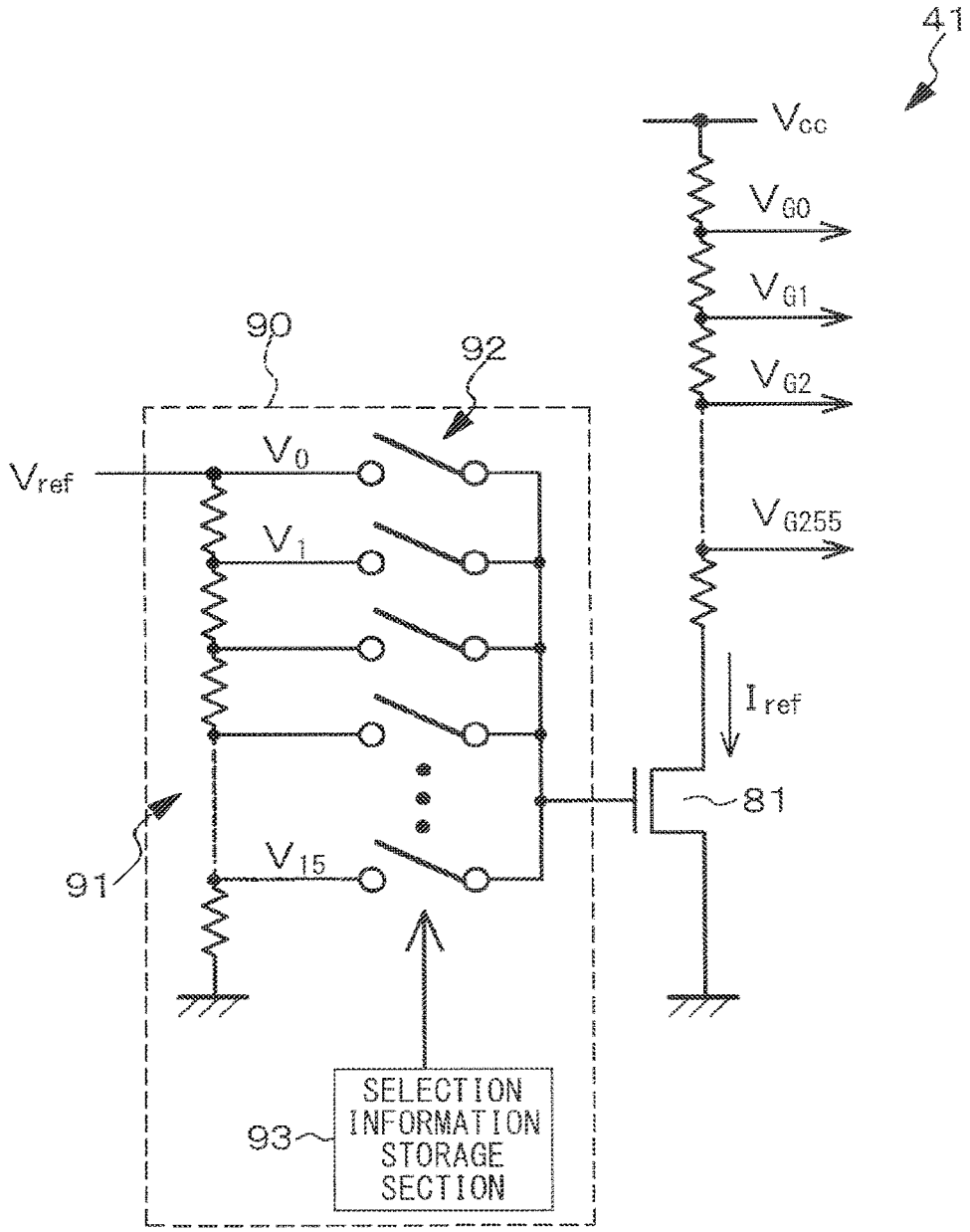
FIG. 6 is a circuit diagram illustrating a circuit configuration of a constant current source according to Example 1.

FIG. 6 is a circuit diagram illustrating a circuit configuration of a constant current source according to Example 1. In Example 1, the constant current source 70 includes a current source transistor 81 and a voltage setting section 90 configured to select one voltage from a plurality of voltages and set the selected voltage as a gate voltage of the current source transistor 81. In Example 1, as will be described later, as the plurality of voltages, sixteen voltages $V_0$ to $V_{15}$ are prepared.

The voltage setting section 90 includes a voltage output section 91, a voltage selection section 92, and a selection information storage section 93. The voltage output section 91 is configured of a ladder resistor circuit. The ladder resistor circuit includes a plurality of resistors connected in series to one another, and is configured to output the plurality of voltages $V_0$ to $V_{15}$ from ends of the respective resistors. The ladder resistor circuit is connected between the first power supply as a power supply on a high-potential side and the second power supply (in this example, the ground GND) as a power supply on a low-potential side, and the voltage of the first power supply serves as the reference voltage $V_{ref}$, and the reference voltage $V_{ref}$ is the highest voltage $V_0$ in the plurality of voltages $V_0$ to $V_{15}$.

An output voltage of a known band gap reference circuit, as a kind of reference voltage circuit, that is not affected by the power supply tolerance ΔV may be used as the reference voltage $V_{ref}$. The output voltage of the band gap reference circuit is typically 1.25 [V]. The output voltage comes from band gap energy of silicon.

The voltage selection section 92 includes a plurality of (sixteen in this example) switch devices (for example, resistors) in which first ends thereof are connected to ends (nodes) of the respective resistors of the ladder resistor circuit, and second ends thereof are connected to a common member, and is configured to select one voltage from the plurality of voltages $V_0$ to $V_{15}$, based on selection information supplied from the selection information storage section 93. The voltage selected by the voltage selection section 92 is set as a voltage determining a current that is to flow through the current source transistor 81, i.e., the gate voltage of the current source transistor 81.

Selection information on a voltage that is supposed to be selected from the plurality of voltages $V_0$ to $V_{15}$ is stored in advance in the selection information storage section 93. This selection information is set, based on a resistance value of a resistor (for example, a poly-resistor) of the ladder resistor circuit 41 and a current $I_{ref}$ flowing through the current source transistor 81 when the gate voltage of the current source transistor 81 is set as the voltage of the first power supply, i.e., the reference voltage $V_{ref}$. Therefore, in the voltage selection section 92, one voltage is selected from the plurality of voltages $V_0$ to $V_{15}$, based on the resistance values of the resistors of the ladder resistor circuit 41 and the current $I_{ref}$ flowing through the current source transistor 81 when the gate voltage is set as the reference voltage $V_{ref}$.

An example of setting of the selection information stored in advance in the selection information storage section 93 will be described below.

Figures 7A, 7B:
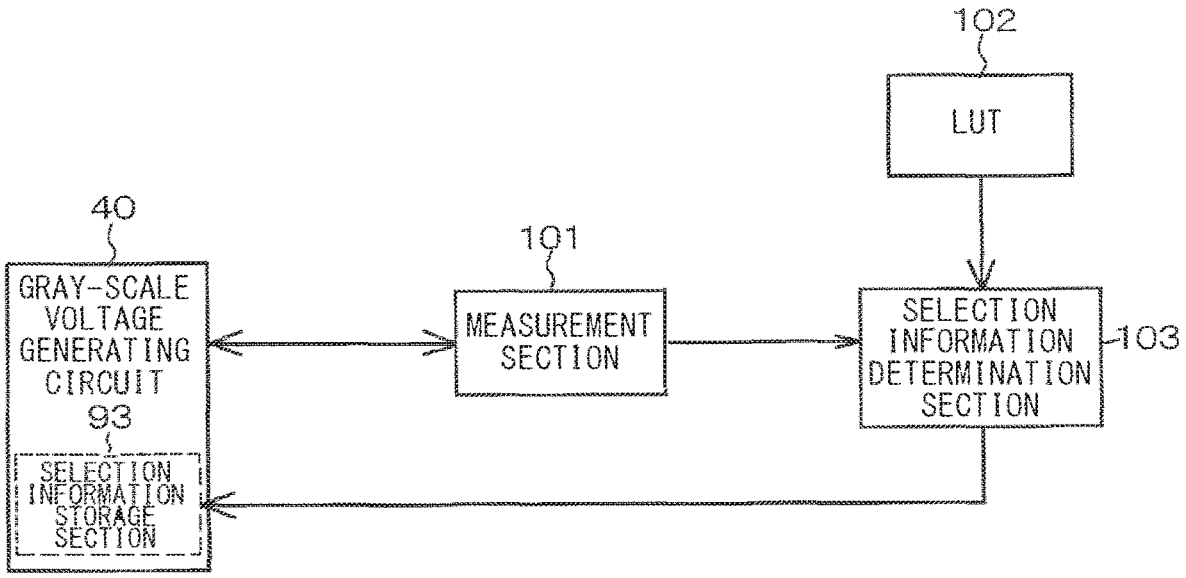
FIG. 7A is a block diagram illustrating an example of a configuration of a system that sets selection information.
FIG. 7B is a diagram illustrating an example of data structure of a look-up table (LUT).

FIG. 7A is a block diagram illustrating an example of a configuration of a system that sets selection information. As illustrated in FIG. 7A, this system includes a measurement section 101, a look-up table (LUT) 102 as an example of a data storage section, and a selection information determination section 103. Setting of selection information by this system is performed on a display panel after manufacturing.

The measurement section 101 actually measures a resistance value of each of the resistors of the ladder resistor circuit 41 and a current value of the current $I_{ref}$ flowing through the current source transistor 81 to find variations in the resistance value of each of the resistors of the ladder resistor circuit 41 and variations in the current $I_{ref}$ caused by variations in characteristics of the current source transistor 81. More specifically, the measurement section 101 measures, for example, a resistance value of one resistor selected from the plurality of resistors of the ladder resistor circuit 41. It is only necessary to measure the resistance value of one resistor, because the resistors of the ladder resistor circuit 41 are formed of same members (for example, poly-resistors) by a same process, and are disposed in proximity to one another; therefore, variations between the resistance values of the respective resistors are negligible. The measurement section 101 further measures the current value of the current $I_{ref}$ flowing through the current source transistor 81 when the gate voltage of the current source transistor 81 is set to, for example, the reference voltage $V_{ref}$ (the voltage of the first power supply).

The LUT 102 and the selection information determination section 103 may be configured as external units. Examples of the external units may include a personal computer and the like. As illustrated in FIG. 7B, the LUT 102 may hold, for example, sixteen different sets in total of selection information on the resistors of the ladder resistor circuit 41 and the current of the current source transistor 81 generated by classifying each of the resistance and the current into four different groups. The sixteen sets of selection information are allowed to be represented by four bits. The groups of the resistance and the current and the number of bits of the selection information corresponding to the groups of the resistance and the current may be arbitrarily set.

The selection information determination section 103 determines selection information, based on a measurement result by the measurement section 101, i.e., the measured resistance value of the resistor of the ladder resistor circuit 41 and the measured current value of the current $I_{ref}$, and selects corresponding 4-bit selection information stored in the LUT 102 to supply the selected selection information to the selection information storage section 93 in the gray-scale voltage generating circuit 40. In an example illustrated in FIG. 7B, when the resistance and the current in a measurement result by the measurement section 101 fall into a group "3" and a group "2", respectively, selection information "0110" is stored in the selection information storage section 93.

Then, in the voltage setting section 90 in Example 1 illustrated in FIG. 6, the voltage selection section 92 selects one voltage from the plurality of voltages $V_0$ to $V_{15}$, based on, for example, the selection information "0110" stored in the selection information storage section 93, and applies the selected voltage as the gate voltage to the current source transistor 81. Thus, change in voltage values of the gray-scale voltages $V_{G0}$ to $V_{G255}$ caused by variations in the resistance value of each of the resistors of the ladder resistor circuit 41 and variations in characteristics of the current source transistor 81 is allowed to be corrected.

3-2. Example 2

In Example 1, each of the resistance of the ladder circuit 41 and the current of the current source transistor 81 is classified into four groups, and sixteen different voltages, i.e., sixteen voltages $V_0$ to $V_{15}$ that are allowed to be set by the voltage setting section 90 are prepared corresponding to the groups of the resistance and the current. When the number of groups of the resistance and the current is increased to thereby increase the number of voltages that are allowed to be set by the voltage setting section 90, change in the voltage values of the gray-scale voltages $V_{G0}$ to $V_{G255}$ caused by variations in the resistance value of each of the resistors of the ladder resistor circuit 41 and variations in characteristics of the current source transistor 81 is allowed to be corrected more accurately. However, when the number of groups of the resistance and the current is increased, a circuit scale of the voltage setting section 90 is increased.

Figure 8:
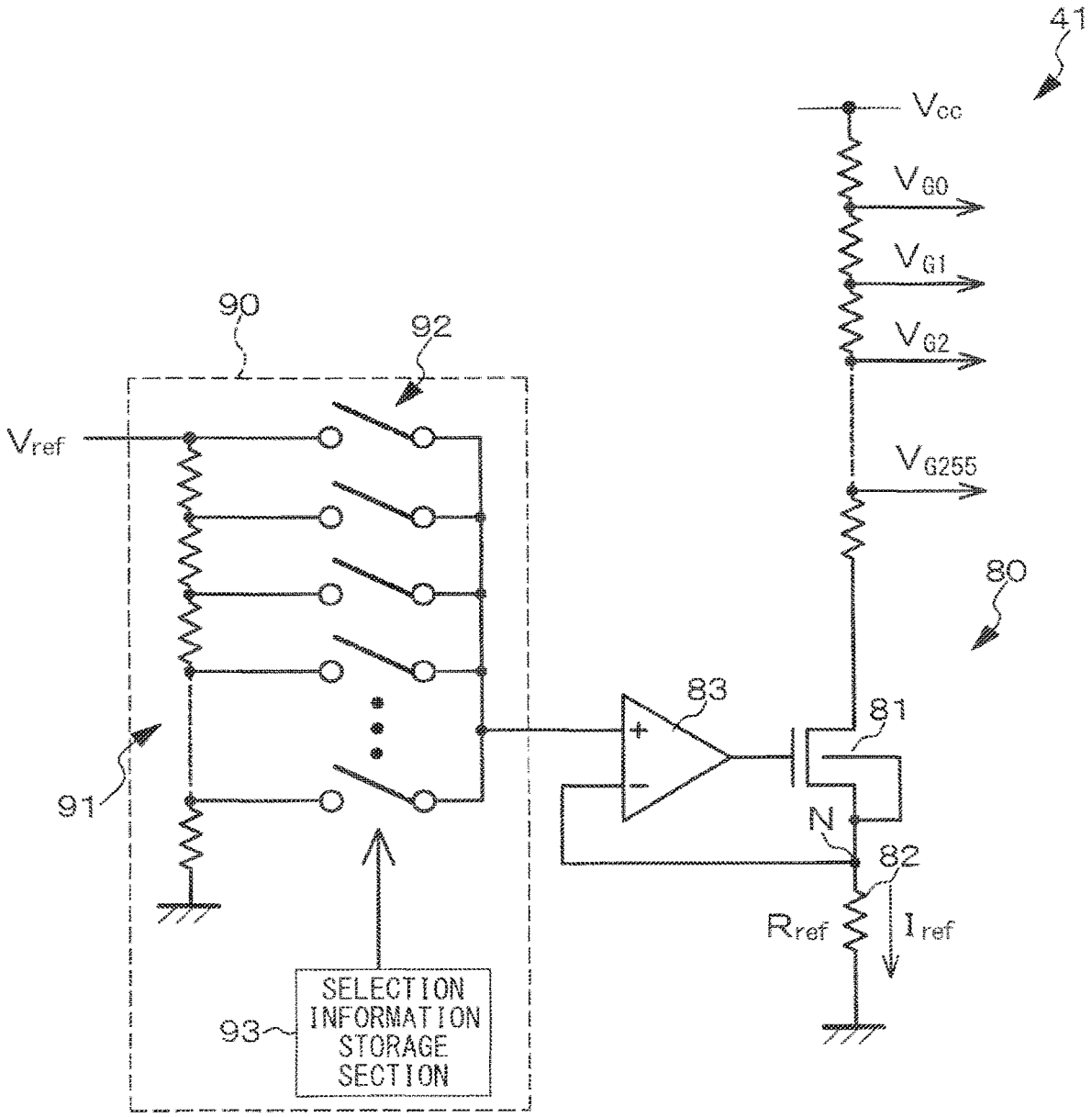
FIG. 8 is a circuit diagram illustrating a circuit configuration of a constant current source according to Example 2.

Example 2 is made to solve the above-described issue. In Example 2, as the constant current source 70, a current output amplifier 80 is used. As illustrated in FIG. 8, the current output amplifier 80 includes a current source transistor 81, a reference resistor 82, and a differential amplifier 83.

The current source transistor 81 is connected in series to the ladder resistor circuit 41. More specifically, one of source and drain electrodes of the current source transistor 81 is connected to an open end of a resistor on a lowest potential side of the ladder resistor circuit 41. The reference resistor 82 is connected in series to the current source transistor 81. More specifically, a first end of the reference resistor 82 is connected to the other one of the source and drain electrodes of the current source transistor 81, and a second end of the reference resistor 82 is connected to a power supply on the low potential side (in this example, a ground GND). The reference voltage $V_{ref}$ as a non-inverting (+) input and a voltage of a connection node N between the current source transistor 81 and the reference resistor 82 as an inverting (−) input are applied to the differential amplifier 83, and the differential amplifier 83 drives the current source transistor 81, based on a difference voltage between the voltage of the connection node N and the reference voltage $V_{ref}$.

In the current output amplifier 80 with the above-described configuration, the reference resistor 82 may be preferably formed of a same member (for example, a poly-resistor) as a member of each of the resistors of the ladder resistor circuit 41 in proximity to the resistors of the ladder resistor circuit 41 by a same process as a process of forming each of the resistors of the ladder resistor circuit 41. When the reference resistor 82 is formed in such a manner, variations in the resistance value of the reference resistor 82 are allowed to be substantially equal to variations in the resistance value of each of the resistors of the ladder resistor circuit 41.

In this case, a current $I_{ref}$ flowing through the reference resistor 82 is determined by the following expression:

$$I_{ref}=V_{ref}/R_{ref}$$

where the resistance value of the reference resistor 82 is $R_{ref}$.

Moreover, the gray-scale voltage (signal voltage) $V_{sig}$ obtained by the ladder resistor circuit 41 is determined by the following expression:

$$\begin{aligned} V_{sig} &= R_{sig} \cdot I_{ref} \\ &= (R_{sig} / R_{ref}) V_{ref} \end{aligned}$$

Variations in the resistance value of each of the resistors of the ladder resistor circuit 41 or the reference resistor 82 occur. The current $I_{ref}$ flowing through the reference resistor 82 is determined by the following expression:

$$I_{ref}=V_{ref}/\alpha R_{ref}$$

where a resistance variation coefficient of the variations is $\alpha$.

On the other hand, in a case where the current output amplifier 80 is used as the constant current source 70, the gray-scale voltage (signal voltage) $V_{sig}$ obtained by the ladder resistor circuit 41 is determined by the following expression:

$$\begin{aligned} V_{sig} &= \alpha R_{sig} \cdot I_{ref} \\ &= (\alpha R_{sig} / \alpha R_{ref}) V_{ref} \\ &= (R_{sig} / R_{ref}) V_{ref} \end{aligned}$$

As can be seen from the above-described expression, the resistance value is included both in voltage-current conversion and current-voltage conversion; therefore, the resistance variation coefficient $\alpha$ is eliminated.

In other words, when the constant current source 70 is connected in series to the ladder resistor circuit 41 and the current output amplifier 80 is used as the constant current source 70, variations in the resistance value of the ladder resistor circuit 41 is allowed to be cancelled. Therefore, the gray-scale voltage (signal voltage) $V_{sig}$ generated by the gray-scale voltage generating circuit 40, i.e., the ladder resistor circuit 41 is allowed to be constant irrespective of variations in the resistance value of each of the resistors of the ladder resistor circuit 41.

Moreover, in the voltage setting section 90, selection information corresponding to an individual difference in the reference voltage $V_{ref}$ or variations in characteristics of the differential amplifier 83 and the like are stored in advance in the selection information storage section 93. Thus, when a voltage applied as a non-inverting (+) input to the differential amplifier 83 is set (the reference voltage is set) by the voltage setting section 90, variations in the gray-scale voltage (signal voltage) $V_{sig}$ caused by variations in characteristics of the differential amplifier 83 and the like is allowed to be corrected.

As described above, in Example 2, change in the voltage values of the gray-scale voltages $V_{G0}$ to $V_{G255}$ caused by variations in the resistance value of the ladder resistor circuit 41 is allowed to be corrected by a function of the current output amplifier 80 by using the current output amplifier 80 as the constant current source 70. Moreover, it is only necessary for the voltage setting section 90 to allow an individual difference in the reference voltage $V_{ref}$ and variations in characteristics of the differential amplifier 83 and the like to be corrected; therefore, compared to Example 1 in which variations in the resistance value of the ladder resistor circuit 41 are corrected by voltage setting by the voltage setting section 90, in Example 2, it is not necessary to increase the number of voltages that are allowed to be set, and the voltage setting section 90 has an advantage that a small circuit scale is only necessary.

(4. Configuration of Present Disclosure)

It is to be noted that the present disclosure may have the following configurations.

[1] A gray-scale voltage generating circuit including:

a ladder resistor circuit including a plurality of resistors connected in series to one another, and configured to output a plurality of gray-scale voltages with different voltage values from ends of the respective resistors; and a constant current source configured to be connected in series to the ladder resistor circuit, in which the constant current source includes a current source transistor configured to be connected in series to the ladder resistor circuit, and a voltage setting section configured to select one voltage from the plurality of voltages and set the selected voltage as a voltage determining a current that is to flow through the current source transistor.

[2] The gray-scale voltage generating circuit according to [1], in which the voltage setting section includes a voltage output section including a plurality of resistors connected in series to one another between a first power supply and a second power supply, and configured to output a plurality of voltages from ends of the respective resistors, and a voltage selection section configured to select one voltage from the plurality of voltages and set the selected voltage as the predetermined voltage that is to be supplied to the differential amplifier.

[3] The gray-scale voltage generating circuit according to [1] or [2], in which the voltage setting section selects one voltage from the plurality of voltages, based on resistance values of the resistors of the ladder resistor circuit.

[4] The gray-scale voltage generating circuit according to [2] or [3], in which the voltage setting section selects one voltage from the plurality of voltages, based on a current flowing through the current source transistor when a gate voltage of the current source transistor is set as the voltage of a first power supply.

[5] The gray-scale voltage generating circuit according to any one of [1] to [4], in which the voltage setting section selects one voltage from the plurality of voltages and sets the selected voltage as a gate voltage of the current source transistor.

[6] The gray-scale voltage generating circuit according to any one of [1] to [4], further including:

a reference resistor configured to be connected to one of source and drain electrodes of the current source transistor; and a differential amplifier configured to drive the current source transistor, based on a difference voltage between a voltage of a connection node between the current source transistor and the reference resistor and a predetermined reference voltage, in which the voltage setting section selects one voltage from the plurality of voltages and sets the selected voltage as the predetermined reference voltage that is to be supplied to the differential amplifier.

[7] A display unit including:

a pixel section configured by arranging pixel circuits each including a light-emitting device;

a gray-scale voltage generating circuit including a ladder resistor circuit and a constant current source, the ladder resistor circuit including a plurality of resistors connected in series to one another, and configured to output a plurality of gray-scale voltages with different voltage values from ends of the respective resistors, the constant current source configured to be connected in series to the ladder resistor circuit; and a drive section configured to convert an input digital image signal into an analog image signal by selecting one gray-scale voltage corresponding to the digital image signal from the plurality of gray-scale voltages generated by the gray-scale voltage generating circuit and drive the light-emitting device by the analog signal, in which the constant current source includes a current source transistor configured to be connected in series to the ladder resistor circuit, and a voltage setting section configured to select one voltage from the plurality of voltages and set the selected voltage as a voltage determining a current that is to flow through the current source transistor.

[8] The display unit according to [7], in which the pixel circuit includes a drive transistor, the drive transistor configured of a P-type transistor and configured to supply a current corresponding to a gate potential to the light-emitting device.

[9] The display unit according to [7] or [8], in which a common power supply is used for the pixel circuits and the ladder resistor circuit.

[10] The display unit according to any one of [7] to [9], in which the light-emitting device is an organic electroluminescence device.

[11] The display unit according to any one of [7] to [10], in which a resistance value of each of the resistors of the ladder resistor circuit is determined, based on gamma characteristics of the pixel section.

It should be understood by those skilled in the art that various modifications, combinations, sub-combinations, and alterations may occur depending on design requirements and other factors insofar as they are within the scope of the appended claims or the equivalents thereof.

What is claimed is:

1. A display device, comprising:

a pixel section that includes a plurality of pixel circuits;

a digital-to-analog (DA) conversion circuit configured to drive the pixel section;

a first voltage generating circuit connected to the DA conversion circuit, wherein the first voltage generating circuit is configured to output a first plurality of voltages, a count of the first plurality of voltages is based on a number of bits of an image signal input to the DA conversion circuit, and the DA conversion circuit is further configured to:

select a first voltage from the first plurality of voltages based on the image signal; and set the selected first voltage as an input to the DA conversion circuit;

a current source transistor connected in series to the first voltage generating circuit; and a second voltage generating circuit that includes:

a voltage output circuit that includes a first plurality of resistors between a first power supply and a second power supply, wherein the voltage output circuit is configured to output a second plurality of voltages; and a voltage selection circuit configured to set a second voltage of the second plurality of voltages as a gate voltage of the current source transistor based on a value of a specific current through the current source transistor when the gate voltage of the current source transistor is set to a voltage of the first power supply.

2. The display device according to claim 1, wherein the voltage output circuit is further configured to output a second plurality of voltages from ends of respective resistors of the first plurality of resistors, the respective resistors of the first plurality of resistors are connected in series, and the voltage selection circuit is further configured to:

select the second voltage from the second plurality of voltages; and set the selected second voltage as the gate voltage of the current source transistor.

3. The display device according to claim 1, wherein the first voltage generating circuit includes a ladder resistor circuit, the ladder resistor circuit includes a second plurality of resistors connected in series, the current source transistor is connected in series to the ladder resistor circuit, and the voltage selection circuit is further configured to:

select the second voltage from the second plurality of voltages, and set the selected second voltage as the gate voltage of the current source transistor.

4. The display device according to claim 3, wherein the voltage selection circuit is further configured to select the second voltage from the second plurality of voltages based on resistance values of respective resistors of the second plurality of resistors.

5. The display device according to claim 3, wherein a resistance value of each of the second plurality of resistors of the ladder resistor circuit is based on gamma characteristics of the pixel section.

6. The display device according to claim 1, further comprising:

a reference resistor connected to one of source electrode of the current source transistor or drain electrode of the current source transistor; and a differential amplifier configured to drive the current source transistor, based on a difference voltage between a reference voltage and a voltage of a connection node between the current source transistor and the reference resistor, wherein the voltage selection circuit is further configured to select the second voltage from the second plurality of voltages and set the selected second voltage as the reference voltage.

7. The display device according to claim 1, wherein each pixel circuit of the plurality of pixel circuits includes a drive transistor, a light emission control transistor, and a light-emitting device.

8. The display device according to claim 7, wherein each of the light emission control transistor and the drive transistor includes a P-type transistor, and the drive transistor is configured to supply a current to the light-emitting device.

9. The display device according to claim 7, wherein the light-emitting device is an organic electroluminescence device.

10. The display device according to claim 7, wherein each pixel circuit further includes:

a sampling transistor configured to sample a signal voltage of the image signal; and a capacitor configured to hold the sampled signal voltage, wherein the capacitor is connected between a gate electrode of the drive transistor and a source electrode of the drive transistor.

11. The display device according to claim 1, further comprises a power supply terminal configured to supply power to the pixel section and the first voltage generating circuit.

12. The display device according to claim 1, further comprises an address decoder connected to the pixel section.

* * * * *